US010907642B2

(12) United States Patent
Gallinelli et al.

(10) Patent No.: US 10,907,642 B2
(45) Date of Patent: Feb. 2, 2021

(54) COMPRESSOR SYSTEM WITH A GAS TEMPERATURE CONTROL AT THE INLET OF THE ANTI-SURGE LINE AND RELEVANT METHOD

(71) Applicant: Nuovo Pignone Tecnologie Srl, Florence (IT)

(72) Inventors: Lorenzo Gallinelli, Florence (IT); Marco Pelella, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 483 days.

(21) Appl. No.: 15/742,953

(22) PCT Filed: Jul. 7, 2016

(86) PCT No.: PCT/EP2016/066097
§ 371 (c)(1),
(2) Date: Jan. 9, 2018

(87) PCT Pub. No.: WO2017/005843
PCT Pub. Date: Jan. 12, 2017

(65) Prior Publication Data

US 2019/0085854 A1 Mar. 21, 2019

(30) Foreign Application Priority Data

Jul. 9, 2015 (IT) ..... 102015000032392

(51) Int. Cl.
*F04D 27/02* (2006.01)
*F04D 17/12* (2006.01)
(Continued)

(52) U.S. Cl.
CPC ..... *F04D 27/0215* (2013.01); *F04D 17/12* (2013.01); *F04D 19/02* (2013.01);
(Continued)

(58) Field of Classification Search
CPC .. F04D 27/0215; F04D 27/0207; F04D 17/12; F04D 19/02; F04D 27/0223; F04D 29/5826
See application file for complete search history.

(56) References Cited

U.S. PATENT DOCUMENTS 4,921,399 A * 5/1990 Lew ..... F04D 27/0207 415/1
2007/0204649 A1* 9/2007 Kaart ..... F25J 1/0087 62/612
2016/0102671 A1* 4/2016 Winkes ..... F04D 29/5826 415/1

FOREIGN PATENT DOCUMENTS

GB 796293 A 6/1958
WO 2014/191312 A1 12/2014

OTHER PUBLICATIONS

Gallinelli, L., et al., Compressor system with a cooling arrangement between the anti-surge valve and the compressor suction side and relevant method, GE Co-Pending Application No. 102015000032409, filed Jul. 9, 2015.

(Continued)

*Primary Examiner* — Eldon T Brockman
(74) *Attorney, Agent, or Firm* — Baker Hughes Patent Organization

(57) ABSTRACT

A compressor system including: a first compressor having a compressor suction side and a compressor delivery side; an anti-surge line having an inlet and an outlet; an anti-surge valve arranged along the anti-surge line and controlled for recirculating a gas flow from the compressor delivery side back to the compressor suction side; a gas temperature manipulation arrangement, functionally connected to the inlet of the anti-surge line, configured to reduce or prevent liquid phase in the anti-surge line when the anti-surge valve is open.

14 Claims, 4 Drawing Sheets

(51) Int. Cl.
*F04D 19/02* (2006.01)
*F04D 29/58* (2006.01)

(52) U.S. Cl.
CPC ..... *F04D 27/0207* (2013.01); *F04D 27/0223* (2013.01); *F04D 29/5826* (2013.01); *F05D 2270/303* (2013.01)

(56) References Cited

OTHER PUBLICATIONS

Wu, J., et al., "A realistic dynamic modeling approach to support LNG plant compressor operations," Engineering Forum, pp. 27-30 (Oct. 2007).
Italian Search Report and Written Opinion issued in connection with corresponding IT Application No. 102015000032392 dated Mar. 10, 2016.
International Invitation to Pay Additional Fees issued in connection with corresponding PCT Application No. PCT/EP2016/066097 dated Sep. 28, 2016.
International Search Report and Written Opinion issued in connection with corresponding PCT Application No. PCT/EP2016/066097 dated Apr. 24, 2017.

* cited by examiner

COMPRESSOR SYSTEM WITH A GAS TEMPERATURE CONTROL AT THE INLET OF THE ANTI-SURGE LINE AND RELEVANT METHOD

FIELD OF THE INVENTION

The disclosure in general relates to compressor systems for processing a gas. More specifically, embodiments disclosed herein concern compressor systems comprising at least one compressor with an anti-surge arrangement.

BACKGROUND

Compressor systems for compressing a working fluid are commonly used in several industrial processes and plants. Typically, compressor systems are used for instance in plants for the liquefaction of natural gas (shortly LNG plants), where natural gas is compressed and liquefied to reduce the volume thereof, for transportation purposes. One or more refrigeration circuits are used to remove heat from the natural gas. A refrigerant fluid is made to circulate in the refrigeration circuit and is subject to cyclic thermodynamic transformations to remove heat from the natural gas and discharge the removed heat to a heat sink.

In essence, a refrigeration circuit comprises a high pressure side and a low pressure side. The refrigerant fluid from the low pressure side of the refrigeration circuit is compressed and cooled in a heat exchanger in heat exchange relationship with a heat sink. The compressed and cooled refrigerant fluid is then expanded in an expansion device, such as an expansion valve or an expander and subsequently flows in a heat exchanger in heat exchange relationship with the natural gas, removing heat therefrom, prior to be compressed again.

A compressor system is used to compress the refrigerant fluid. The compressor system usually includes one or more compressors, such as centrifugal compressor(s) and/or axial compressor(s), where through the refrigeration fluid is compressed from the low pressure to the high pressure of the refrigeration cycle. Each compressor is usually comprised of an anti-surge line, connecting the delivery side of the compressor to the suction side thereof. An anti-surge valve arranged along the anti-surge line is selectively opened during start-up of the compressor, or when the operating conditions of the compressor are such that the operating point approaches the surge line. Recirculation of the processed gas prevents surging phenomena, which could otherwise result in serious damages to the compressor.

The anti-surge line has an inlet and an outlet. The inlet is fluidly coupled to the delivery side of the compressor and the outlet is fluidly coupled to the suction side of the compressor. Since the compressed gas delivered by the compressor is at a higher temperature than the low-pressure gas at the suction side of the compressor, the inlet of the anti-surge line is arranged downstream of a gas cooler, such that cooled gas enters the anti-surge line. This prevents overheating of the compressor during transient operating conditions, when the anti-surge valve is open.

If the working gas processed by the compressor, for instance a refrigeration gas for LNG, contains components of different molecular weights, the heavier components may condense in the gas cooler downstream the compressor and produce a liquid phase in the gas flow. In this case, if the anti-surge valve is opened, the fluid which circulates in the anti-surge line and through the anti-surge valve contains a percentage of liquid. Depending upon the operating conditions and the position of the compressor in the refrigeration cycle, the percentage of condensed gas can be relatively high, e.g. above 30% by weight or even equal to or higher than 40% by weight.

Typically, LNG plants using a so-called mixed refrigerant are subject to gas condensation in the gas cooler arranged upstream of the inlet of the anti-surge line. Mixed refrigerant can usually contain a mixture of propane, ethane, methane and possibly other components, such as nitrogen, isobutene, n-butane and the like. Especially the heavier components (propane and ethane) can condense in the gas cooler giving rise to a high amount of condensed gas in the refrigerant flow. The anti-surge valve can be damaged by the liquid flowing therethrough.

Similar issues may arise in any compression facility comprised of a compressor system with a compressor and an anti-surge line and anti-surge valve arrangement, whenever the temperature of the gas flowing through the gas cooler downstream of the compressor can drop below the dew point, i.e. the point where the heavier components of the gas start condensing.

A need therefore exists, to improve compressor systems, in order to prevent or alleviate the above mentioned drawbacks.

SUMMARY OF THE INVENTION

According to some aspects of the disclosure, a compressor system is provided comprising at least a first compressor having a suction side and a delivery side. An anti-surge line having an inlet and an outlet is connected in parallel to the compressor, the inlet of the anti-surge line being arranged to receive compressed gas from the delivery side of the compressor, and the outlet of the anti-surge line being arranged to return the gas flowing through the anti-surge line towards the suction side of the compressor. An anti-surge valve is arranged along the anti-surge line and is controlled for recirculating a gas flow from the delivery side back to the suction side of the compressor. A gas temperature manipulation arrangement, functionally connected to the inlet of the anti-surge line, is further provided. The gas temperature manipulation arrangement is configured to reduce or prevent liquid phase in the anti-surge line when the anti-surge valve is open.

According to a further aspect, a compressor system is disclosed, comprising: at least a first compressor having a suction side and a delivery side; an anti-surge line having an inlet and an outlet; an anti-surge valve arranged along the anti-surge line and controlled for recirculating a gas flow from the delivery side back to the suction side of the compressor; a first gas cooler arranged downstream of the delivery side of the compressor and fluidly coupled therewith; a second gas cooler arranged downstream of the first gas cooler and fluidly coupled therewith; wherein the inlet of the anti-surge line is arranged between the first gas cooler and the second gas cooler. The first gas cooler and second gas cooler can be formed by two sections of an integrated gas cooler arrangement. The first gas cooler operates as a de-superheater. Partly cooled gas from the first gas cooler enters the anti-surge valve, so that liquid phase in the anti-surge line is prevented or substantially limited. According to yet a further aspect, a compressor system is disclosed, comprising: at least a first compressor having a suction side and a delivery side; an anti-surge line having an inlet and an outlet; an anti-surge valve arranged along the anti-surge line and controlled for recirculating a gas flow from the delivery side back to the suction side of the compressor; a gas cooler arranged downstream of the delivery side of the compressor and fluidly coupled therewith; a gas cooler by-pass line, such that hot gas from the delivery side of the compressor can flow through the gas cooler by-pass line directly in the anti-surge line, without flowing through the gas cooler.

The gas temperature in the anti-surge line can be controlled and manipulated by increasing or decreasing the amount of hot gas from the delivery side of the compressor, which is mixed with gas from the gas cooler, such that liquid in the anti-surge line is reduced or avoided.

According to a further aspect, methods for processing a gas in a compressor system are described, comprising the following steps:

processing a gas through the compressor of the compressor system;

cooling the gas outflowing from the delivery side of the compressor;

when gas is required to recirculate through an anti-surge line in parallel to the compressor, opening the anti-surge valve causing partly cooled gas to flow through the anti-surge line and the anti-surge valve back to the suction side of the compressor.

To prevent or reduce the amount of liquid phase in the anti-surge line, and at the same time to prevent overheating of the compressor when the anti-surge valve is partly or entirely open, a gas temperature manipulation arrangement is provided, which is functionally connected to the inlet of the anti-surge line.

The gas temperature manipulation arrangement can be comprised of two sequentially arranged gas coolers, with the anti-surge line inlet being fluidly coupled between the first gas cooler and second gas cooler. Partly cooled gas, e.g. de-superheated gas, is thus delivered through the anti-surge line.

In other embodiments the gas temperature is controlled by mixing gas exiting a gas cooler and gas by-passing the gas cooler, the mixture flowing through the anti-surge line. The amount of gas by-passing the gas cooler is adjusted such that no liquid phase or a reduced amount of liquid phase is present in the gas flowing through the anti-surge line and the anti-surge valve.

Compressor systems and methods according to the present disclosure allow reduction or elimination of a liquid phase in the anti-surge line, such that simpler and less expensive anti-surge valves can be used. Some embodiments of the compressor system disclosed herein can be configured and controlled such that the gas flowing in the anti-surge line is entirely free of liquid. Other embodiments may be such that total elimination of the liquid phase is not achieved, or that some liquid can be present under certain operating conditions. In any case the total amount of liquid will be less than in current systems. If presence of liquid can be expected, or in any case to ensure a safer and more reliable operation of the system, liquid-tolerant anti-surge valves can still be used in the system. The absence or reduced amount of liquid phase in the anti-surge line will in any case ensure a more reliable operation of the system and a longer MTBF (Meant Time Between Failures) of the anti-surge valve.

Other features and advantages of the invention will be better appreciated from the following detailed description of exemplary embodiments.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

As will be described in more detail herein after, according to embodiments of the subject matter disclosed herein, downstream of a gas compressor a dual arrangement of gas coolers is provided, with a first gas cooler and a second gas cooler being arranged in sequence. An anti-surge line is arranged in parallel to a gas compressor. The inlet of the anti-surge line is arranged between the first gas cooler and second gas cooler.

In the context of the present description and attached claims, the first gas cooler and the second gas cooler can be formed by two sections of a single gas cooler arrangement, having two or more sections. In some embodiments, one section of the gas cooler arrangement operates as a de-superheater and a subsequent downstream section operates as a condenser or partial condenser, i.e. the gas flowing therethrough is at least partly condensed by heat exchange with a cooling medium, such as air or water.

When different sections of a gas cooler arrangement embody the first gas cooler and second gas cooler, the inlet of the anti-surge line is connected between the two sections of the gas cooler arrangement.

The gas delivered by the compressor is thus cooled in a two-step cooling process. In an embodiment, the operation of at least one gas cooler is controlled such that between the first gas cooler and the second gas cooler the gas is free of a liquid phase, i.e. of condensed gas. In some embodiments, the first gas cooler is operating as a de-superheater, the gas exiting therefrom being still superheated, such that heavier gas components are still not condensed.

In the description and in the appended claims, unless differently specified, the terms "upstream" and "downstream" are referred to the direction of the gas flow.

According to some embodiments, the operation of the gas cooler is controlled such that the amount of liquid phase is small, e.g. not exceeding about 30% by weight, in an embodiment not exceeding about 20% by weight, even more particularly, not exceeding about 10% by weight. In some exemplary embodiments the amount of liquid phase does not exceed about 5% by weight. In general, the percentage of liquid phase in the anti-surge line depends substantially upon the compressor efficiency, the composition of the processed gas and temperature of the gas at the gas cooler outlet.

The operation of the first gas cooler can be controlled such that the temperature of the gas flowing therethrough does not drop below the dew point, i.e. below a temperature at which, at the given pressure and gas composition conditions, a liquid phase starts separating from the gas.

The anti-surge line draws partly cooled gas between the first gas cooler and the second gas cooler, such that overheating of the compressor is avoided when the anti-surge valve is open.

Figure 1:
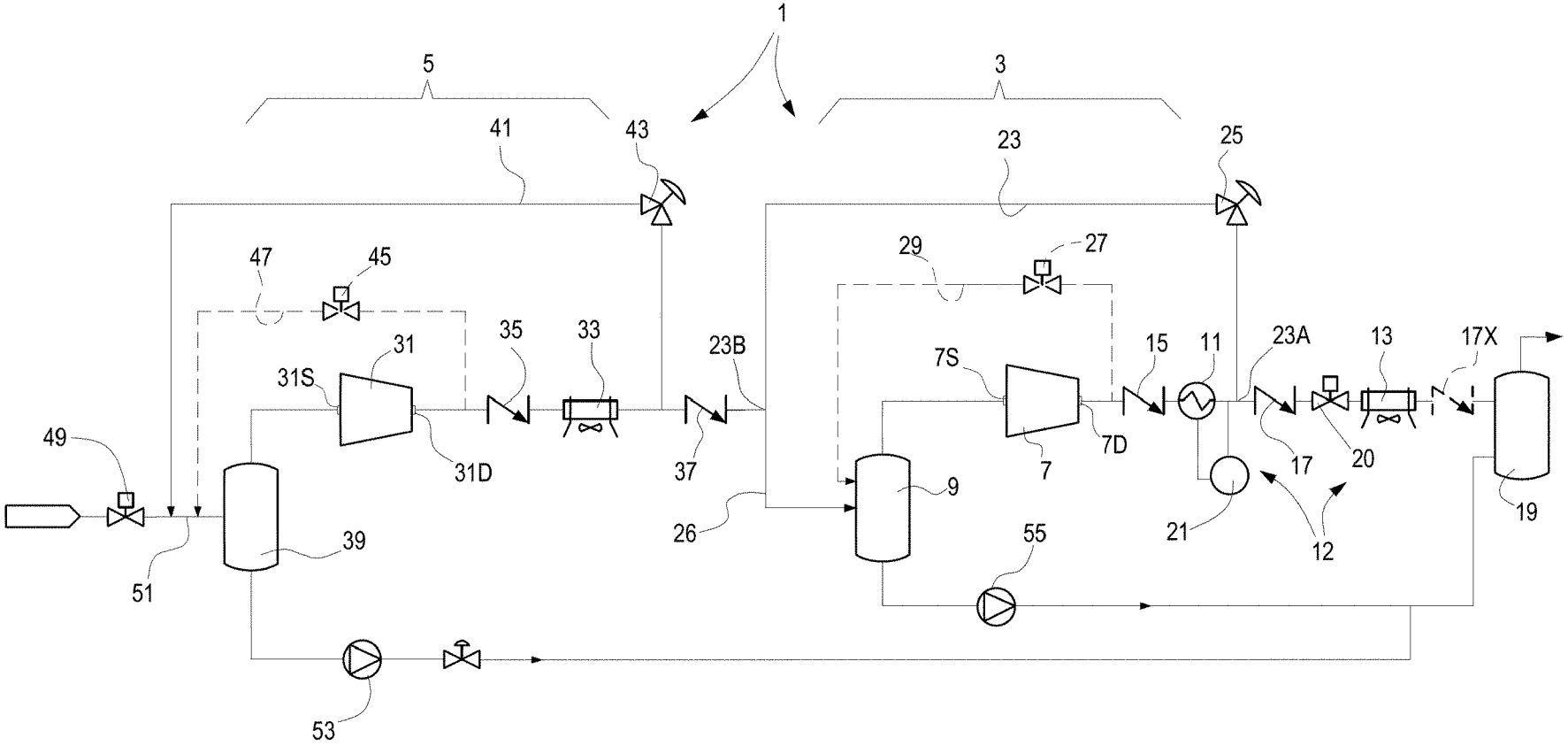
FIG. 1 illustrates a schematic of a compressor system according to an embodiment.

Referring now to FIG. 1, reference number 1 globally indicates a compressor system according to the present disclosure. In the embodiment of FIG. 1, the compressor system 1 comprises a first section 3 and a second section 5, the second section 5 being arranged upstream of the first section 3 with respect to the gas flow through the compressor system 1.

The first section 3 comprises a first compressor 7 having a suction side 7S and a delivery side 7D. The first compressor 7 can be for instance an axial compressor or a centrifugal compressor.

Gas processed by the first compressor 7 enters the compressor at the suction side 7S at a suction pressure and is delivered, at a delivery pressure, at the delivery side 7D, the delivery pressure being higher than the suction pressure. The suction side 7S of the first compressor 7 can be fluidly coupled to a suction drum 9. The suction drum 9 is a liquid/gas separator that separates a liquid phase (e.g. condensed gas) possibly present in the gas flow, from the gaseous phase, which is sucked through the suction side 7S, such that the gas entering the first compressor 7 is substantially free of liquid.

Downstream of the delivery side 7D of the first compressor 7 a first gas cooler 11 and a second gas cooler 13 are sequentially arranged. The first gas cooler 11 is fluidly coupled to the delivery side 7D of the first compressor 7 and receives a flow of compressed gas therefrom. The partly cooled gas flow exiting the first gas cooler 11 flows through the second gas cooler 13.

The first gas cooler 11 and the second gas cooler 13 are part of a gas temperature manipulation arrangement 12, which is arranged and configured to prevent or reduce a liquid phase present in an anti-surge line arranged in parallel to the first compressor 7, as will be described herein after.

According to some arrangements, a check valve 15 can be arranged between the delivery side 7D of the first compressor 7 and the inlet of the first gas cooler 11. A discharge check valve 17 can be arranged between the first gas cooler 11 and the second gas cooler 13. Alternatively or in addition to the discharge check valve 17, a discharge check valve 17X can be arranged downstream of the second gas cooler 13.

Downstream of the second gas cooler 13 a liquid/gas separator 19 is arranged, wherein condensed gas is separated from the gaseous phase of the compressed and cooled gas flow exiting the second gas cooler 13.

The first gas cooler 11 can include a gas/water heat exchanger, a gas/air heat exchanger, or a combination thereof, or any other heat exchanger, depending upon the heat sink available and the ambient conditions at the location where the compressor system 1 is installed and/or upon the operating conditions of the compressor system 1. Similarly, the second gas cooler 13 can include a gas/water heat exchanger, a gas/air heat exchanger, or a combination thereof, or any other heat exchanger, depending upon the heat sink available at the location where the compressor system 1 is installed and/or upon the operating conditions thereof. The first gas cooler 11 and the second gas cooler 13 can use the same cooling fluid, e.g. air or water, or different cooling fluids, for instance one can use water and the other can use air.

According to some embodiments, a shut-down valve 20 can be arranged between the first gas cooler 11 and the second gas cooler 13.

The first gas cooler 11 can be provided with a temperature controller 21. The temperature controller 21 can be functionally connected to a temperature sensor (not shown), arranged for detecting the temperature of the gas flow at the outlet of the first gas cooler 11. The temperature controller 21 can have a temperature set point which is slightly above the dew point of the gas flowing through the compressor system 1. For instance the temperature set point Ts of the temperature controller 21 can be set as follows:

$$Ts=Td+Tm$$

where

Ts is the set-point temperature of temperature controller 21

Td is the dew point

Tm is a temperature safety margin.

The temperature controller 21 forms part of the gas temperature manipulation arrangement and can control for instance an air fan or a cooling water pump, such that gas temperature at the outlet of the first gas cooler 11 is maintained around the temperature set point Ts.

A first anti-surge line 23 is arranged in parallel to the first compressor 7. The first anti-surge line 23 has an inlet 23A and an outlet 23B. The inlet 23A of the first anti-surge line 23 is arranged between the first gas cooler 11 and the second gas cooler 13, while the outlet 23B of first anti-surge line 23 is fluidly coupled to the suction side 7S of the first compressor 7. In the arrangement shown in FIG. 1, the outlet 23B of the anti-surge line 23 is fluidly coupled to the suction side 7S of the first compressor 7 through a gas feeding line 26, which is in turn in fluid communication with the first suction drum or liquid/gas separator 9.

A first anti-surge valve 25 is arranged along the first anti-surge line 23. The first anti-surge valve 25 is controlled in a manner known to those skilled in the art, in order to partly or totally open during certain operative transient conditions of the first compressor 7. For instance, the first anti-surge valve 25 is open at start-up of the first compressor 7. The first anti-surge valve 25 is further opened if the operating point of the compressor 7 approaches the so-called surge-control line, to prevent damages to the compressor.

A hot gas by-pass valve 27 and a respective hot gas by-pass line 29 can also be provided, if needed, to establish a further connection between the delivery side 7D and the suction side 7S of the first compressor 7.

The compressor system 1 of the embodiment illustrated in FIG. 1 comprises a second section 5, upstream of the first section 3 with respect to the general gas flow direction through the compressor system 1. The second section 5 comprises a second compressor 31 with a suction side 31S and a delivery side 31D. A third gas cooler 33 can be arranged downstream of the delivery side 31D of the second compressor 31. A check valve 35 can be arranged between the delivery side 31D of compressor 31 and the third gas cooler 33. Furthermore, a discharge check valve 37 can be arranged downstream of the third gas cooler 33.

The third gas cooler 33 is in fluid communication with the first suction drum or liquid/gas separator 9 through the discharge valve 37. A second suction drum 39 can be provided upstream of the suction side 31S of the second compressor 31. The second suction drum 39 operates as a liquid/gas separator for separating liquid, e.g. condensed gas, from the gaseous stream delivered to the suction side 31S of the second compressor 31.

A second anti-surge line 41, comprised of a second anti-surge valve 43, is connected between the outlet of the third gas cooler 33 and the inlet of the second suction drum or liquid/gas separator 39. A hot gas by-pass valve 45 on a hot gas by-pass line 47 can also be provided in parallel to the second compressor 31.

A shut down valve 49 can further be arranged upstream of the second suction drum 39, along a gas inlet duct 51, in fluid communication with the suction side 31S of the second compressor 31.

The compressor system 1 described so far operates as follows. Gas is fed through gas inlet duct 51 and through the second suction drum 39 to the suction side 31S of the second compressor 31. As mentioned, the gas can comprise a mixture of different gaseous components, e.g. propane, ethane, methane, nitrogen and the like. Liquid possibly present in the incoming gas flow can be separated in the second suction drum 39 and delivered to the liquid/gas separator 19 or to a separate liquid tank (not shown). A pump 53 can pump the liquid from the low pressure inside the second suction drum 39 to the high pressure in the liquid/gas separator 19 or other liquid tank.

The gas from the second suction drum 39 is compressed by the second compressor 31 and cooled in the third gas cooler 33 and subsequently fed to the first section 3 of the compressor system 1 through the first suction drum 9. Liquid present in the gas flow can be separated in the first suction drum 9 and delivered to the liquid/gas separator 19, for instance, or to another liquid tank, not shown. A pump 55 can be used to boost the liquid pressure from the pressure inside the first suction drum 9 to the high pressure inside the liquid/gas separator 19, or other liquid tank. In other embodiments, not shown, the condensed gas separated in the suction drum 9 can be delivered to a condensed gas tank or a suction drum at a pressure lower than the pressure in suction drum 9, such that no pump is required.

The gas is further compressed in the first compressor 7 and delivered at the delivery side 7D thereof through the first gas cooler 11 and the second gas cooler 13 and finally delivered to the liquid/gas separator 19.

In some operating conditions, part or all the gas flow can be diverted through the second anti-surge line 41 by opening the second anti-surge valve 43. The gas recirculating through the second anti-surge line 41 has been previously cooled in the third cooler 33. The operating conditions of the compressor system 1 can be such that the amount of liquid phase (i.e. condensed gas) present at the outlet of third gas cooler 33 is sufficiently small, such that the second anti-surge valve 43 is not damaged by the liquid flowing therethrough.

In some operating conditions, part or all the gas flow can be diverted through the first anti-surge valve 25 and the first anti-surge line 23. Since cooling of the compressed gas exiting the first compressor 7 is performed in two steps through the first gas cooler 11 and the second gas cooler 13, the gas entering the first anti-surge line 23 is substantially free of condensed gas, or contains a limited amount of liquid phase, as mentioned above. Damages to the first anti-surge valve 25 are prevented or at least substantially reduced. A liquid-tolerant anti-surge valve 25, i.e. a valve capable of withstanding a bi-phase flow, can be employed if desired. At the same time, the gas circulating in the first anti-surge line 23 is sufficiently cold, to prevent overheating of the first compressor 7.

Figure 2:
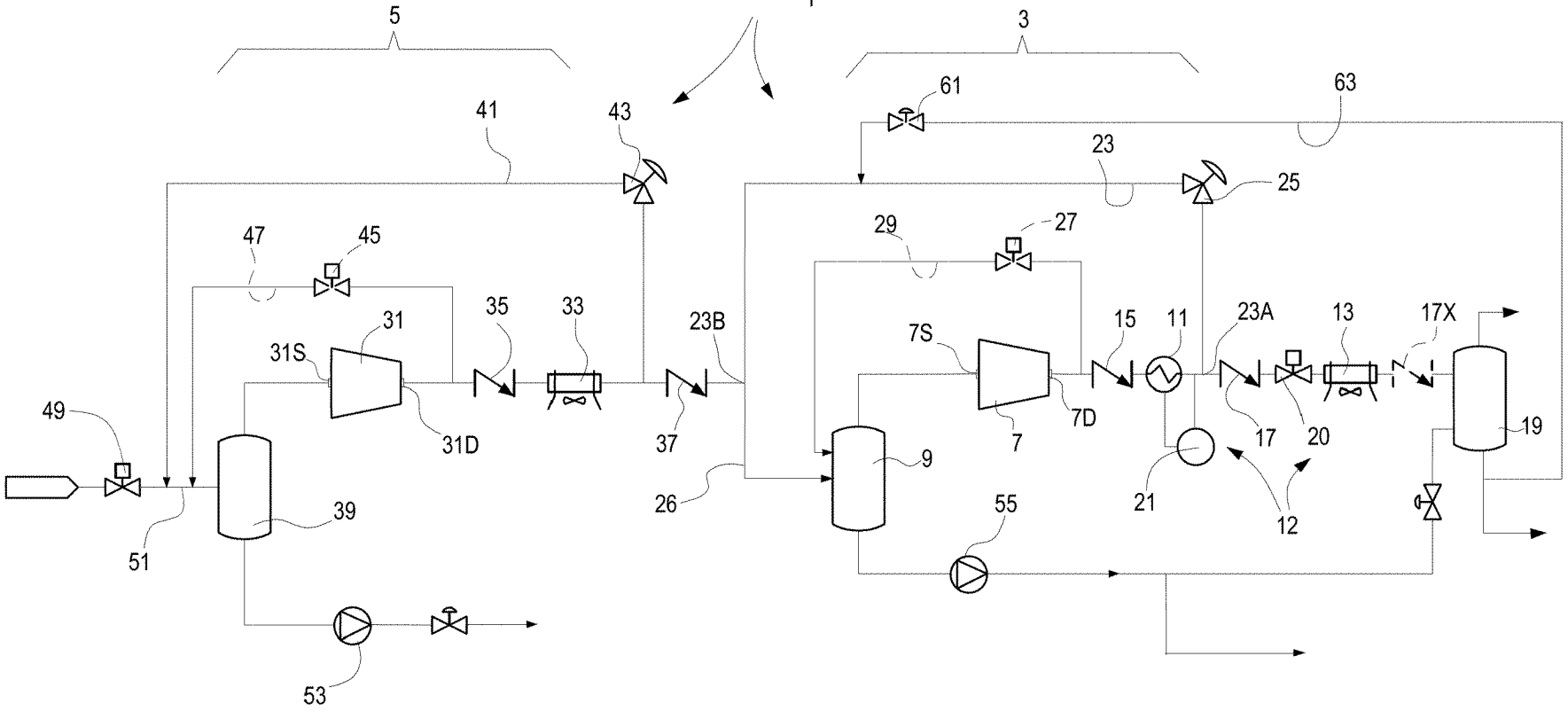
FIG. 2 illustrates a schematic of a compressor system according to an embodiment.

FIG. 2 illustrates a further embodiment of the compressor system 1 of the present disclosure. The same elements, parts and components as already disclosed in connection with FIG. 1 are labeled with the same reference numbers and will not be described again.

The compressor system 1 of FIG. 2 differs from the compressor system 1 of FIG. 1 in that the first section 3 of the compressor system 1 comprises a quench valve 61 provided along a quench line 63. The quench valve 61 can be part of the gas temperature manipulation arrangement 12.

The inlet of the quench line 63 is fluidly coupled to a source of condensed gas. The outlet of the quench line 63 is fluidly coupled to the first anti-surge line 23. More specifically, the source of condensed gas can be the liquid/gas separator 19, as schematically shown in FIG. 2. In other embodiments, a different condensed gas source can be provided, for instance a condensed gas tank, where condensed gas is present.

A pressure drop is provided across the quench valve 61, such that when the quench valve 61 is opened, a flow of condensed gas from the condensed gas source is sprayed in the first anti-surge line 23, between the first anti-surge valve 25 and the outlet 23B of the first anti-surge line 23, i.e. downstream of the first anti-surge valve 25 with respect to the direction of gas flow along the first anti-surge line 23.

During transient operation of the compressor system 1, when the first anti-surge valve 25 opens and causes compressed and cooled gas from first gas cooler 11 to recirculate towards the suction side 7S of the first compressor 7, a flow of condensed gas can be sprayed through the quench valve 61 in the first anti-surge line 23. The sprayed condensed gas mixes with the flow of compressed gas from the first anti-surge valve 25, which has been partly cooled in the first gas cooler 11. The higher temperature of the recirculated gas from the first anti-surge valve 25 causes abrupt evaporation of the condensed gas, sprayed by the quench valve 61. The condensed gas evaporates absorbing latent heat, such that the total gas flow, i.e. the gas flowing through the first anti-surge valve 25 and the evaporated gas from the quench valve 61, has a temperature lower than the temperature at the outlet of the first gas cooler 11. An enhanced cooling of the gas returning towards the suction side 7S of the first compressor 7 is thus obtained, which more effectively prevent overheating of the first compressor 7, also in case the first anti-surge valve 25 remains open for a long time period.

Possible condensed gas present in the flow returning towards the suction side 7S of the first compressor 7 can be separated from the gas flow in the first suction drum or liquid/gas separator 9.

In some embodiments, the quench valve 61 can be used only during start-up of the compressor system 1. During start-up the first gas cooler 11 is sufficient to chill the gas from the first compressor 7 and re-cycled through the anti-surge line 23. The quench valve 61 can be controlled by a temperature controller, based on a temperature at the suction side 7S of the compressor 7. The quench valve 61 will thus be usually closed during steady-state operation of the compressor system 1, to prevent too low a gas temperature at the suction side 7S of the first compressor 7.

According to further embodiments, not shown, a similar quench valve can be provided also in the second section 5.

Figure 3:
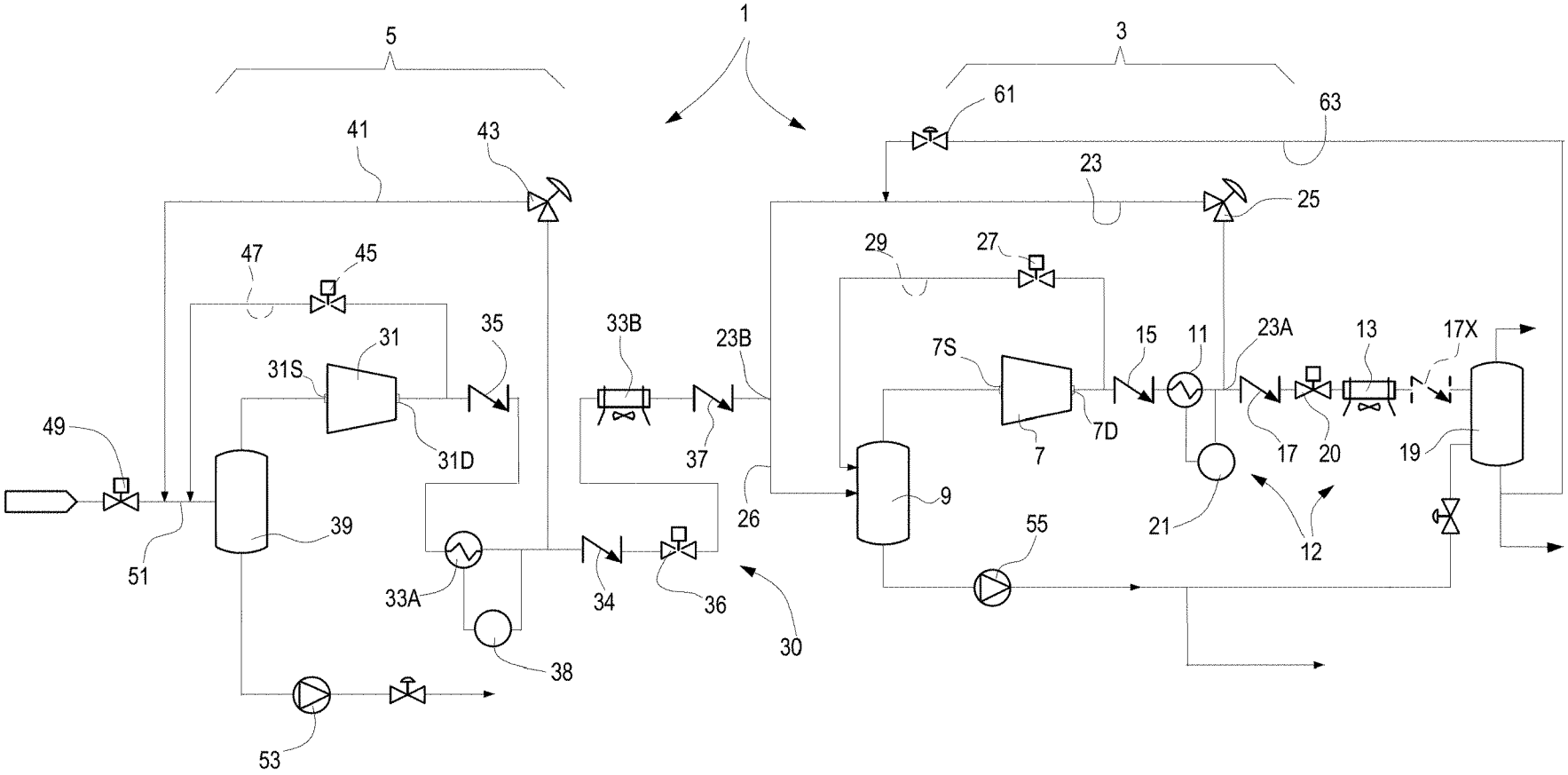
FIG. 3 illustrates a schematic of a compressor system according to an embodiment.

FIG. 3 illustrates a yet further embodiment of a compressor system 1 according to the present disclosure. The same elements, parts and components as already disclosed in connection with FIGS. 1 and 2 are labeled with the same reference numbers and will not be described again.

The compressor system 1 of FIG. 3 differs from the compressor system 1 of FIG. 2 in that the second section 5 comprises a further gas temperature manipulation arrangement 30, arranged and configured for preventing or limiting liquid phase in the anti-surge line in parallel to the second compressor 31. In some embodiments, in a way similar to the first section 3, the gas temperature manipulation arrangement 30 of the second section 5 comprises two gas coolers.

More specifically, in the embodiment of FIG. 3, the second section 5 comprises a third gas cooler 33A and a fourth gas cooler 33B, arranged in series. In some embodiments, a discharge check valve 34 can be arranged between the third gas cooler 33A and the fourth gas cooler 33B. The third gas cooler 33A and the fourth gas cooler 33B can be sections of a single gas cooler arrangement. In such case, the check valve 34 can be omitted.

In some embodiments, a shutdown valve 36 can further be arranged between the third gas cooler 33A and the fourth gas cooler 33B, e.g. between the discharge check valve 34 and the fourth gas cooler 33B.

The third gas cooler 33A and the fourth gas cooler 33B can be in heat exchange relationship with a flow of cooling medium, e.g. air or water. The same cooling medium or different cooling media can be used for the third gas cooler 33A and the fourth gas cooler 33B.

A second temperature controller 38 can be combined with the third gas cooler 33A. The second temperature controller 38 can operate in quite the same way as the temperature controller 21, to control the third gas cooler 33A, such that the temperature of the gas flowing therethrough remains above the dew point.

The operation of the compressor system 1 of FIG. 3 is substantially the same as the operation of the compressor system 1 of FIG. 2. In addition, the gas flowing through the second anti-surge line 41 can be cooled by the third gas cooler 33A, prior to entering the second anti-surge line 41, such that said gas is substantially free of liquid phase, i.e. of condensed gas.

In a further embodiment, not shown, the quench valve 61 and the quench line 63 of the arrangement of FIG. 3 can be omitted.

In some embodiments, not shown, a quench valve arrangement and a respective quench line can be provided in the second section 5, in quite the same way as in section 3.

In yet further embodiments, the compressor system 1 can include only one section, namely section 3.

In still further embodiments, the compressor system 1 can include more than two sections, with a third compressor and a similar arrangement of anti-surge line and relevant anti-surge valve.

Figure 4:
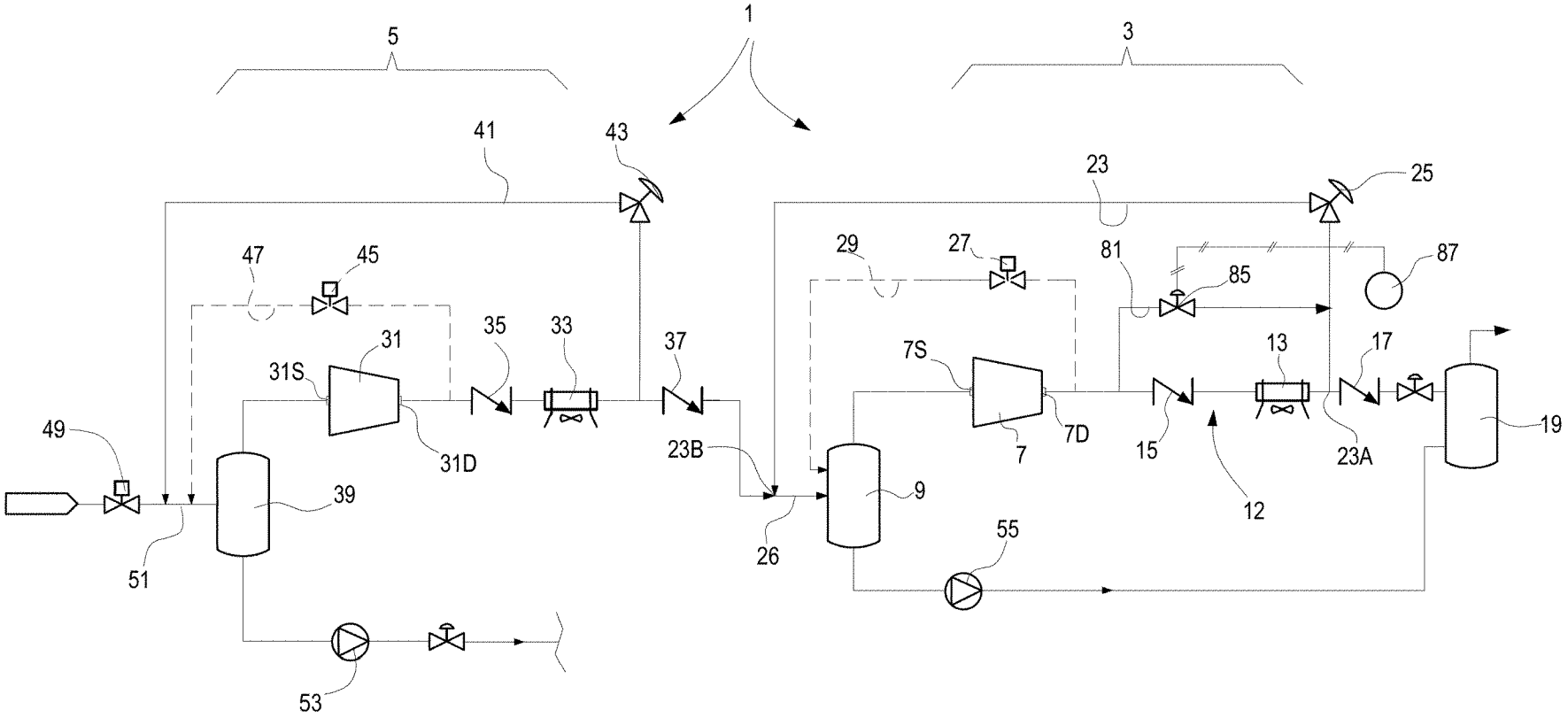
FIG. 4 illustrates a schematic of a compressor system according an embodiment.

FIG. 4 illustrates a further embodiment of a compressor system 1 according to the present disclosure. The same reference numbers designate the same or equivalent parts, components or elements as disclosed in connection with the previous embodiments of FIGS. 1 to 3. These components will not be described again. The arrangement of FIG. 4 differs from the arrangement of FIGS. 1, 2 and 3 mainly for a different structure and operation of the gas temperature manipulation arrangement 12.

In the embodiment of FIG. 4 the second section 5 is configured as in the embodiment of FIG. 1. In other exemplary embodiments, not shown, the second section 5 of FIG. 4 can be configured as shown in FIG. 3. In general, the features of FIG. 4 which will be described herein below can be combined with one or more of the features of the previously described embodiments.

In the arrangement of FIG. 4, the first section 3 comprises a single gas cooler 13, e.g. a gas/air cooler or a gas/water cooler. The gas temperature manipulation arrangement 12 can comprise a gas cooler by-pass line 81, the inlet whereof is fluidly coupled to the delivery side 7D of compressor 7, between the delivery side 7D and the gas cooler 13, for instance between the delivery side 7D and the check valve 15. An outlet of the gas cooler by-pass line 81 is fluidly coupled to the anti-surge line 23, between the inlet 23A of the anti-surge line 23 and the anti-surge valve 25. A gas cooler by-pass valve 85 is arranged along the gas cooler by-pass line 81.

When the anti-surge valve 25 opens, the temperature of the gas entering the anti-surge line 23 can be controlled by means of the gas cooler by-pass valve 85. For instance, if the gas temperature at the outlet of the gas cooler 13 is such that a liquid phase can be present, a side-flow of superheated gas from the delivery side 7D of the first compressor 7 is allowed to enter the anti-surge line 23 upstream of the anti-surge valve 25 through the gas cooler by-pass line 81. The temperature of the gas flowing through the anti-surge valve 25 is thus increased, removing or reducing the amount of liquid phase. Possible liquid phase, e.g. condensed gas, present in the anti-surge line 23 will vaporize due to mixture with the hot gas from the gas cooler by-pass line 81.

In some embodiments, a temperature controller 87 is provided, which is functionally connected to a temperature sensor (not shown) arranged in the anti-surge line 23, upstream of the anti-surge valve 25. If the temperature of the gas flowing through the anti-surge valve 25 is too low, the temperature controller 87 acts upon the gas cooler by-pass valve 85, to allow a controlled amount of hot gas from the first compressor 7 to enter the anti-surge line 23 without flowing through the gas cooler 13, thus causing vaporization of possible liquid present in the gas flowing from the gas cooler 13 in the anti-surge line 23.

In all embodiments disclosed above, the anti-surge valves can be liquid-tolerant valves, i.e. suitable to withstand passage of a bi-phasic flow containing some amount of liquid phase. The features of the embodiments disclosed herein, aimed at eliminating or reducing the presence of liquid phase in the fluid flowing in the anti-surge line will improve the efficiency and reliability of the system and increase the MTBF of the valves.

The above described compressor system 1 can be part of an LNG plant, wherein the refrigerant of at least one refrigeration cycle of the LNG plant is processed in the compressor system 1 and is subsequently expanded and flows in a heat exchanger arrangement, to remove heat from a flow of natural gas to be liquefied.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification and in the appended claims, specify the presence of the stated features, integers, steps, operations, elements and/or components, but do not preclude the presence or addition of one or more other features, integers, steps, operations, elements, components and/or groups thereof.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A compressor system comprising:

at least a first compressor having a suction side and a delivery side;

an anti-surge line having an inlet and an outlet;

an anti-surge valve arranged along the anti-surge line and controlled to recirculate a gas flow from the delivery side to the suction side of the first compressor;

a gas temperature manipulation arrangement connected to the inlet of the anti-surge line and configured to reduce or prevent liquid phase in the anti-surge line when the anti-surge valve is open, the gas temperature manipulation arrangement comprising a first gas cooler arranged downstream of the delivery side of the first compressor and fluidly coupled therewith and a second gas cooler arranged downstream of the first gas cooler and fluidly coupled therewith, the inlet of the anti-surge line arranged between the first gas cooler and the second gas cooler; and a downstream liquid/gas separator in fluid communication with the second gas cooler and configured to separate condensed gas from a main flow of gas phase from the second gas cooler.

2. The compressor system of claim 1, further comprising a gas cooler by-pass line fluidly coupled to the delivery side of the first compressor and to the anti-surge line upstream of the anti-surge valve.

3. The compressor system of claim 2, wherein a gas cooler by-pass valve is provided along the gas cooler by-pass line.

4. The compressor system of claim 3, further comprising a temperature controller arranged and configured for controlling the gas cooler by-pass valve to adjust a hot gas flow from the delivery side of the first compressor to the anti-surge line.

5. The compressor system of claim 1, wherein the first gas cooler is configured and controlled such that the gas exiting the first gas cooler is substantially free of condensed gas.

6. The compressor system of claim 5, further comprising a temperature controller, configured and arranged to control the operating conditions of the first gas cooler, such that the gas exiting the first gas cooler is substantially free of a condensed gas.

7. The compressor system of claim 1, further comprising an upstream liquid/gas separator in fluid communication with the suction side of the first compressor, configured and arranged for removing a liquid phase from a gas flow entering the first compressor.

8. The compressor system of claim 1, further comprising a discharge check valve arranged downstream of the inlet of the anti-surge line.

9. The compressor system of claim 8, wherein the discharge check valve is arranged upstream of the second gas cooler.

10. The compressor system of claim 1, further comprising a second compressor, arranged upstream of the first compressor, and provided with a respective suction side and a respective delivery side, and with a second anti-surge line, having respective inlet and outlet; wherein a second anti-surge valve is arranged along the second anti-surge line, between the inlet and the outlet thereof, and controlled for recirculating a gas flow from the delivery side of the second compressor to the suction side of the second compressor.

11. The compressor system of claim 10, further comprising a third gas cooler is arranged downstream of the discharge side of the second compressor and fluidly coupled therewith; and the inlet of the second anti-surge line is arranged downstream of the third gas cooler.

12. The compressor system of claim 11, further comprising a fourth gas cooler, arranged downstream of the third gas cooler and fluidly coupled therewith; and wherein the inlet of the second anti-surge line is arranged between the third gas cooler and the fourth gas cooler.

13. A natural gas liquefaction plant, comprising a natural gas duct in heat exchange relationship with a refrigerant circuit, arranged and configured for removing heat form natural gas flowing in the natural gas duct; wherein the refrigerant circuit comprises a compressor system according to claim 1.

14. A compressor system comprising:

at least a first compressor having a suction side and a delivery side;

an anti-surge line having an inlet and an outlet;

an anti-surge valve arranged along the anti-surge line and controlled to recirculate a gas flow from the delivery side to the suction side of the first compressor;

a gas temperature manipulation arrangement connected to the inlet of the anti-surge line and configured to reduce or prevent liquid phase in the anti-surge line when the anti-surge valve is open, the gas temperature manipulation arrangement comprising a first gas cooler arranged downstream of the delivery side of the first compressor and fluidly coupled therewith and a second gas cooler arranged downstream of the first gas cooler and fluidly coupled therewith, the inlet of the anti-surge line arranged between the first gas cooler and the second gas cooler; and a quench valve fluidly coupled to a reservoir containing a condensed gas separated from the gas processed by the first compressor and at a pressure higher than a gas pressure at the suction side of the first compressor, the quench valve further fluidly coupled between the anti-surge valve and the suction side of the first compressor and arranged and controlled to spray a flow of the condensed gas in a gas stream flowing through the anti-surge line.

* * * * *